United States Patent [19]

Chisholm

[11] 4,424,084

[45] Jan. 3, 1984

[54] ALUMINUM ALLOY

[75] Inventor: Matthew F. Chisholm, Pittsburgh, Pa.

[73] Assignee: Reynolds Metals Company, Richmond, Va.

[21] Appl. No.: 297,873

[22] Filed: Aug. 31, 1981

Related U.S. Application Data

[63] Continuation-in-part of Ser. No. 180,365, Aug. 22, 1980, abandoned.

[51] Int. Cl.[3] ..... C22C 21/14

[52] U.S. Cl. ..... 148/417; 148/159

[58] Field of Search ..... 75/141, 142; 148/32, 148/32.5, 159

[56] References Cited

U.S. PATENT DOCUMENTS 4,000,007 12/1976 Develay et al. ..... 75/141

*Primary Examiner*—R. Dean

*Attorney, Agent, or Firm*—Alan T. McDonald

[57] ABSTRACT

Aluminum base alloys containing 0.5 to 1.3% silicon, 0.8 to 1.8% copper, 0.1 to 0.4% manganese, 0.4 to 1.0% magnesium, up to 0.6% iron, 0.20% chromium, 0.5% zinc, 0.15% titanium and 0.05% each of other components up to 0.15% total, the balance aluminum are described.

Such alloys demonstrate optimum strength, formability and corrosion resistance properties for use as autobody sheet alloys.

6 Claims, No Drawings

ALUMINUM ALLOY

This is a continuation-in-part of application Ser. No. 180,365, filed Aug. 22, 1980, abandoned.

BACKGROUND OF THE INVENTION

1. Field of the Invention:

The present invention relates to aluminum alloys and more specifically to 2XXX series aluminum alloys which because of their various properties are optimally suited for autobody sheet applications.

2. DISCUSSION OF THE PRIOR ART:

The increased use of lightweight aluminum in automotive and other energy intensive applications is well known in the art.

Attempts to design an aluminum alloy which demonstrates the high strength, formability and corrosion resistance demanded by these applications has to date, not been highly successful. Thus, for example, the following alloys registered by the Aluminum Association have been proposed for autobody sheet use: 2002, 2036, 2037, 2117, 5182, 6009 and 6010. Although highly useful materials, none of these alloys has consistently demonstrated all of the characteristics required for these demanding applications.

Perhaps the prior art alloys most similar in composition to those claimed in the instant application are the 2002 alloys which are described in U.S. Pat. No. 4,000,007 to Develay et al issued Dec. 28, 1976. These alloys specify 0.4–0.8% silicon, 1.5–2.5% copper, 0.5–1.0% magnesium and less than 0.5% iron. Such materials may be susceptible to unacceptable corrosion when the strength property is made equal to that of the alloys of the present invention. According to this patent: (a) alloys with copper contents below 1.5% demonstrate inadequate mechanical properties; and (b) alloys with silicon contents above about 0.8% demonstrate poor hemming characteristics. Work performed in alloy development in Germany during the late 1930's and early 1940's was directed to the examination of relatively low copper-containing alloys that could match the strength of Al-Cu-Mg alloys. This work led to the formulation of alloys with 0.65–1.0% Si, 1.4–2.0% Cu, 0.7% Mn and 0.8–1.4% Mg. Those involved in this work were concerned primarily with strength and had little concern with formability or corrosion resistance. In the course of the work which culminated in the alloys of the present invention, it has been found that generally lower levels of copper are necessary to prevent lessen corrosion and that lower levels of copper, manganese and magnesium are necessary to achieve adequate formability for autobody sheet uses.

SUMMARY OF THE INVENTION

It has now been discovered that in Al-Cu-Mg-Si alloys reduction of the copper level below the 1.5% minumum level specified by aforementioned U.S. Pat. No. 4,000,007 when properly balanced with modifications of the silicon and magnesium levels yields alloys optimally suited for use in autobody sheet and which demonstrate improved corrosion resistance, formability and specifically preferred aging characteristics. The lower Cu content also results in lower −T4 strength since the strength in the naturally aged temper is acquired mainly through the formation of Cu-rich GP zones. This is an advantage when forming this material.

However, with the proper levels of Si and Mg, these alloys can be artifically aged to yield strengths over 50 ksi. The hardening phase of the alloy described herein, readily responds at the time/temperature conditions associated with a paint-bake cycle. Significant increases in strength can be acquired even without a deliberate artificial age. The strengths of other 2XXX-series alloys developed for automotive applications (2002, 2117, 2036 and 2037) increase only slightly, if any, during a paint-bake cycle. Furthermore, I have observed no effect on formability due to silicon content. For optimum results, the silicon content should be maintained between about 0.2 and about 0.8% excess (optimally greater than about 0.4% excess) over x where x=Mg content/1.7. Silicon contents in this range significantly increase the aging response of the Al-Cu-Mg alloy.

The discovery of a low Cu alloy which demonstrates improved corrosion resistance exhibits excellent formability and can be strengthened in a conventional paint-bake cycle offers a prime candidate for autobody sheet of aluminum.

Thus, the present invention provides aluminum base Al-Cu-Mg-Si alloys comprising 0.8–1.8% Cu, 0.8–1.8% Mg, 0.5–1.3% Si, 0.1–0.4% Mn and up to 0.6% Fe, 0.2% Cr, 0.5% Zn, and 0.15% Ti. Other elements may each be present at levels up to 0.05% but in total cannot exceed 0.15%. Such alloy compositions demonstrate excellent formability improved resistance to corrosion and yield strengths above 45 ksi when artificially aged, for example, by treatment at 350° F. for 8 hours. Exposure to conventional paint-bake cycle, i.e. exposure to a temperature of between about 350° and about 450° F. for a period of from about 10 to about 40 minutes, may increase yield strength to above about 40 ksi. A typical such cycle of one manufacturer lasts about 30 minutes at about 400° F.

According to to a preferred embodiment, the following levels of Cu, Mg and Si are present: 0.9–1.4% Cu, 0.5–.85% Mg and 0.7–1.1% Si. It is further preferred to maintain the following maximum levels of other ingredients: 0.30% Fe, 0.10% Cr, 0.20% Zn, and 0.05% Ti.

Although Cu has less effect than Mg on formability, increased Cu levels reduce the alloy's ability to form tight bends and reduced Cu levels, improve the general corrosion resistance of the alloy. Cu levels below about 1.4% are preferred because of a susceptibility to corrosion cracking with Cu levels above this value.

The addition of Si significantly increases the aging response of Al-Cu-Mg alloys. Si levels between about 0.2 and 0.8% excess (optimally greater than 0.4% excess) over X where X=Mg content/1.7, are preferred.

The preferred range of 0.5–0.85% Mg results in an alloy with good formability and strength. The ability to form a tight bend as in a in a die bead is reduced if the Mg content exceeds the preferred about 0.85% Mg content.

EXAMPLE I

Table I compares the tensile properties of Alloys 2002-T4, 2036-T4 and 6010-T4 with those of the alloys of the present invention, (designated alloy "A").

The properties shown for the various alloys are for sheet in the −T4 temper, after a simulated typical paint-bake cycle at 400° F. for 30 minutes and in the −T6 temper.

Several laboratory formability indices were determined on the sheet produced from the alloy of the present invention. These results are compared with those of the 2002, 2036 and 6010 alloys in Table II.

TABLE I

COMPARATIVE TENSILE PROPERTIES OF ALUMINUM AUTOBODY ALLOYS (TRANSVERSE DIRECTION)

| Condition (All Typical) | Properties | "A" | 2036 | 6010 | 2002 |
|---|---|---|---|---|---|
| -T4 | UTS (ksi) | 47 | 49 | 42 | 49 |
| | YS (ksi) | 25 | 28 | 25 | 27 |
| | Elong. (%) | 25 | 24 | 24 | 25 |
| -T4 + ½ hr. at 400° F. | UTS (ksi) | 53 | 54 | 49 | 49 |
| | YS (ksi) | 43 | 33 | 43 | 36 |
| | Elong. (%) | 14 | 21 | 11 | 16 |
| -T6 | UTS (ksi) | 55 | 52 | 52 | — |
| | YS (ksi) | 47 | 43 | 47 | — |
| | Elong. (%) | 12 | 12 | 12 | — |

TABLE II

COMPARATIVE FORMABILITY PARAMETERS OF ALUMINUM AUTOBODY ALLOYS

| Properties | "A" | 2036 | 6010 | 2002 |
|---|---|---|---|---|
| UTS (ksi) | 47 | 49 | 42 | 49 |
| YS (ksi) | 25 | 28 | 25 | 27 |
| Elong. in 2" (%) | 25 | 24 | 24 | 25 |
| Tensile/Yield Ratio | 1.88 | 1.75 | 1.68 | 1.81 |
| $\bar{n}$ | 0.26 | 0.23 | 0.22 | .24 |
| $\bar{r}$ | 0.75 | 0.75 | 0.70 | .63 |
| Minimum Bend Radius (in metal thick.) | 0.30–0.60T | 0.75–1.20T | 0.50–1.00T | 0.6–1.0T |
| LDH* (in.) | 0.97–1.00 | 0.95–1.00 | 0.93–0.97 | — |
| Springback Angle** (°) | 81–86 | 90–92 | 81–86 | — |

*"Limiting Dome Height", LT blanks lubricated with petroleum jelly.
**Springback angle after 1" × 14" × 0.040" strip is wrapped 180° around a 2.5" radius cylinder and released.

EXAMPLE II

The data in Tables III and IV permit graphic comparison of certain of the properties of the alloys of the present invention when compared to those of other somewhat similar alloys.

The composition of the alloys was as follows:

| | Alloy A | B | C | D | E |
|---|---|---|---|---|---|
| Si % | 0.90 | 0.55 | 1.00 | 0.88 | 0.89 |
| Fe % | 0.22 | 0.22 | 0.22 | 0.22 | 0.22 |
| Cu % | 1.27 | 1.93 | 1.90 | 1.42 | 1.43 |
| Mn % | 0.26 | 0.26 | 0.26 | 0.26 | 0.26 |
| Mg % | 0.60 | 0.59 | 0.65 | 0.44 | 0.88 |

In each case the alloy was cast as a DC ingot suitable for rolling. The ingot was homogenized at temperatures from 900° to 1050° F. for at least one hour, hot rolled to a sheet thickness of 0.180" and then cold rolled to a final thickness of 0.035". This sheet was solution heat treated in a continuous furnace at 990° F. and then cold water quenched.

The tensile properties and aging response, of each of the alloys was then evaluated using conventional techniques with the results shown below.

TENSILE PROPERTIES

The tensile properties (T4) shown in Table III are from transverse specimens, i.e. the direction of rolling is perpendicular to the long dimension of the sample.

TABLE III

| Alloy | Ultimate Tens. (ksi) | Yield Strength (ksi) | F (%) |
|---|---|---|---|
| A | 46.7 | 25.6 | 24.5 |
| B | 51.3 | 28.8 | 24.0 |
| C | 54.1 | 30.9 | 25.0 |
| D | 44.1 | 22.6 | 24.5 |
| E | 51.9 | 28.4 | 25 |
| Mild Steel | 40–45 | 21–28 | — |

The T-4 strength of all of these alloys combinations are adequate when compared to those of mild steel sheet, the material these alloys are intended to replace. The somewhat lower yield strength of alloy A as compared to the others is an advantage when forming because the lower yield strength alloy will have less "springback" and demonstrate increased metal flow.

AGING RESPONSE

Another important property of Al-Cu-Mg-Si alloys is their ability to age harden when exposed to the time temperature cycles normally used during the baking of painted panels. The substantial increases in strength which are achievable allow the users of this alloy to use thinner sheet in applications where strength is a design criteria. The aging response is possible through proper selection of the Cu, Mg and most importantly the Si contents. We have found that the Si level should be between 0.2 and 0.8% excess (optimally greater than 0.4%) over x where x=Mg content/1.7.

TABLE IV

| Alloy | Transverse Tensile Properties After a Paint Bake Cycle* UTS (ksi) | YS (ksi) | E |
|---|---|---|---|
| A | 54.0 | 43.6 | 14.7 |
| B | 55.1 | 42.0 | 15.0 |
| C | 63.0 | 49.5 | 14.7 |
| D | 47.8 | 38.4 | 12.0 |
| E | 59.6 | 50.8 | 11.5 |

*1 hr. @ 375° F.

Comparing Alloys B and C demonstrates the important role of Si. with nearly identical Cu and Mg contents, alloy C with 1.0% Si (0.6% excess) age hardened substantially more than Alloy B with 0.55% Si (0.2% excess).

FORMABILITY

Although a fairly wide range of Cu-Mg-Si combination will produce adequate T4 tensile properties, the composition has been limited by formability considerations. Reducing the Cu and Mg levels results in improved hemming characteristics as measured by the minimum bend radius. However, if the Cu content is reduced to levels below 0.8 wt% the benificial effect of Cu on the strain-hardening characteristics, an important factor in stretchability, is lost.

What is claimed is:

1. An aluminum base alloy consisting essentially of about 0.9–1.4% Cu, 0.5–1.3% Si, 0.4–1.0% Mg, 0.1–0.4% Mn, up to about 0.6% Fe, 0.2% Cr, 0.5% Zn, 0.15% Ti and up to 0.15% other elements which each individually do not exceed 0.05% in concentration, balance aluminum; said alloy having been aged to the —T6 temper in an aging cycle which comprises exposure to a temperature of between about 350° F. and about 450° F. for a period of between about 10 and about 40 minutes, to thereby produce an alloy characterized by excellent formability, resistance to corrosion and yield strength above 45 ksi.

2. An aluminum base alloy consisting essentially of about 0.8–1.8% Cu, 0.7–1.1% Si, 0.4–1.0% Mg, 0.1–0.4% Mn, up to about 0.6% Fe, 0.2% Cr, 0.5% Zn, 0.15% Ti and up to 0.15% other elements which each individually do not exceed 0.05% in concentration, balance aluminum; said alloy having been aged to the —T6 temper in an aging cycle which comprises exposure to a temperature of between about 350° F. and about 450° F. for a period of between about 10 and about 40 minutes, to thereby produce an alloy characterized by excellent formability, resistance to corrosion and yield strength above 45 ksi.

3. The aluminum alloy of claim 2 having a copper content of about 0.9–1.4%.

4. The aluminum alloy of claim 2 having a magnesium content of about 0.5–0.85%.

5. The aluminum alloy of claim 1 or claim 2 wherein Si is present in an excess of about 0.2–0.8% over x where x = Mg content/1.7.

6. The aluminum alloy of claim 5 wherein Si is present in an excess greater than 0.4%.

* * * * *